United States Patent [19]

Schvester

[11] Patent Number: 4,840,280

[45] Date of Patent: Jun. 20, 1989

[54] SEALING CAP FOR LIQUID FOOD OR BEVERAGE CONTAINERS

[75] Inventor: Pascal Schvester, Chicago, Ill.

[73] Assignee: American Air Liquide, New York, N.Y.

[21] Appl. No.: 149,498

[22] Filed: Jan. 28, 1988

[51] Int. Cl.[4] ..... B65D 85/72

[52] U.S. Cl. ..... 215/228

[58] Field of Search ..... 426/118, 124; 215/228

[56] References Cited

U.S. PATENT DOCUMENTS 4,104,192 8/1978 Yoshikawa et al. .
4,113,652 9/1978 Yoshikawa et al. .
4,127,503 11/1978 Yoshikawa et al. .
4,166,807 9/1979 Komatsu et al. .
4,192,773 3/1980 Yoshikawa et al. .
4,199,472 4/1980 Ohtsuka et al. .
4,287,995 9/1981 Moriya ..... 215/228
4,332,845 6/1982 Nawata et al. .
4,366,179 12/1982 Nawata et al. .
4,399,161 8/1983 Nakamura et al. .

*Primary Examiner*—Donald F. Norton
*Attorney, Agent, or Firm*—Lee C. Robinson, Jr.

[57] ABSTRACT

In the beer industry or the like, presence of oxygen in the headspace of the containers or bottles is particulary undesirable. The sealing cap or lid according to the invention is provided with oxygen absorber or scavenger means sufficient to absorb rapidly the volume of oxygen remaining in the headspace of the container after the filling and sealing operations.

8 Claims, 1 Drawing Sheet

SEALING CAP FOR LIQUID FOOD OR BEVERAGE CONTAINERS

BACKGROUND OF THE INVENTION

In the food industry, liquids or beverages have to be deoxygenated in order to avoid any oxidation reactions or microbial growth which might take place during storage of the product. Leaving traces of oxygen in liquid foods, beverages, or pharmaceutical liquids reduces significantly their shelf-life and leads to early spoilage of the product. Therefore, liquid foods, beverages or pharmaceutical liquds are deoxygenated or are renderd inert before the final packaging or bottling operations. The deoxygenation step is usually performed in a holding tank where an inert gas such as $N_2$ will strip away the dissolved oxygen when sparged through the liquid food.

However, during the filling stage of the final container, the deoxygenated liquid or beverage comes in contact with ambient air present in the container, particularly when this container has not been rendered inert. Leaving residual air in the headspace of the container after completion of the filling operation results in a transfer of the oxygen present in this headspace back into the liquid. Therefore, a major concern in the food industry is to develop a technique allowing purging of the headspace of the filled container with an inert gas before sealing or placing a lid on it. The residual partial pressure of oxygen in the headspace should usually not exceed 0.5%.

In the beer industry where the presence of oxygen in the headspace of the containers is particularly undesirable, the remaining air is purged via a step where the product is made to foam. Once transferred from the holding tank into the container, the beer is often made to foam by the introduction of a brief and pressurized jet of water. The resulting desorption of dissolved $CO_2$ from the beer creates the foam which rises and flows out of the bottleneck. Such an operation is sufficient to purge the air from the container headspace and to replace it with $CO_2$, but it leads to considerable losses of the contained product (between 1% and 5% of the final volume of that liquid).

In order to avoid the foaming step and the resulting loss of the product, solutions which consist of flushing out the air from the container's headspace with an inert gas, such as $N_2$ or $CO_2$, have been used, but did not yet succeed in lowering the residual $O_2$ partial pressure in the headspace to a value less than 0.5%. In addition, the volume of gas required for the flushing operation may be high. Therefore, there has not been any satisfactory solution proposed to remove the oxygen from the headspace of liquid food or beverage containers after filling.

Certain chemical products are known to be obygen scavengers or absorbers as for example those disclosed in U.S. Pat. No. 4,113,652 ,4,104,192, 4,199,472, 4,127,503, 4,166,807, 4,192,773. All these and further patents are incorporated herein as references . Such products, like active iron oxides are react, in the presence of moisture, with gaseous oxygen to form iron oxides and hydroxides:

$$Fe(OH)_2+\tfrac{1}{4}O_2+\tfrac{1}{2}H_2O—Fe(OH)_3$$

In other words, ferrous $\{Fe^{+2}]$ hydroxide in the presence of moisture with gaseous oxygen reacts to form ferric $\{Fe^{+3}]$ hydroxide.

Such chemicals are already widely used for the preservation of fresh, packed or prepared foods to remove the residual oxygen from the container and to extend the shelf-life of the product. In a common practice, these chemicals are wrapped in a permeable sachet which allws the permeation of oxygen and water vapor, while avoiding direct contact between the absorber and food. However, the presence of liquid in direct contact with the sachet is to be avoided since this creates a limitation of the permeation of the gas through the sachet. On the other hand, the direct contact of the liquid food with these chemicals is not recommended.

U.S. Pat. No. 4,332,845, 4,366,179 and 4,399,161 disclose some possible use of the above mentionned oxygen absorbers or scavengers. U.S. Pat. No. 4,399,161 discloses a method of storing a dewatered solid food in a gas tight packaging with oxygen absorbing means in a gas permeable package not suitable to avoid liquid contact with said absorber means. Furthermore, said solid food is packaged in a plastic tray before being packed in the air tight packaging, the oxygen absorber means being, in its own package, provided between these two envelopes. As described in U.S. Pat. No. 4,332,845, the product cannot be used with a liquid food or pharmaceutical packaging system for the following reasons : an oxygen absorber placed in a sealed bag is inappropriate for the removal of oxygen contained in the gaseous headspace of a container if immersed in the liquid food or pharmaceutical contained in the container. Therefore, the bag has to be placed and maintained in the headspace of the container. Such a requiement is impossible to achieve in the case of an automatic filling line unless the time between filling and lidding or sealing steps is considerably extended. If such is the case, the productivity of the line is significantly reduced. On the other hand, considering the shape or geometry of commercial liquid containers used with automatic filling lines, an oxygen absorber placed within a bag cannot be placed and maintained in the headspace of the container.

SUMMARY OF THE INVENTION

According to the invention, there is provided in the container's lid or cap or on the surface of the container's lid or cap which is adapted to be in contact with the contained liquid, an amount of $O_2$ scavenger or absorber sufficient to absorb rapidly the volume of oxygen remaining in the headspace of the container after the filling and sealing operations. In order to avoid the direct contact of the chemical absorbent with the liquid, a film combining high permeability to gaseous oxygen (in the range of 10,000 cc/m$^2$.bar. h, or more) and to water vapor but impermeable to liquids is used as a barrier between the chemical absorbent and the contained liqid. Therefore, projections of droplets occuring during any transport of the container will not alter the permeation of oxygen. Such a film is made from a rubber (polydialkyl siloxane) or PTFE based component, and has a thickness preferably between 0.1 and 0.5 mm.

According to a preferred embodiment of the invention, the combination of oxygen absorber and protective film is introduced during the manufacturing of caps and lids which will be ready for use immediately after the filling operation. This new sealing device can be used in association with an inert gas flushing process in order to reduce the gas consumption involved in this technique. Once in place, the oxygen absorption reaction is initiated and the residual oxygen in the container's headspace is removed. The partial pressure of oxygen can be lower than 0.01%. The velocity of oxygen absorption is a function of the film premeability and of the amount of available chemical in the cap. In an industrial process, these values are chosen in order to reach an oxygen partial pressure lower than 0.5% after less than ½ hour.

BRIEF DESCRIPTION OF THE DRAWINGS

Other and further features of the invention will be clearly understood by reference to the following description of various embodiments of the invention chosen for purpose of illustration only, along with the claims and the accompanying drawings, wherein :

DETAILED DESCRIPTION OF THE INVENTION

Figure 1:
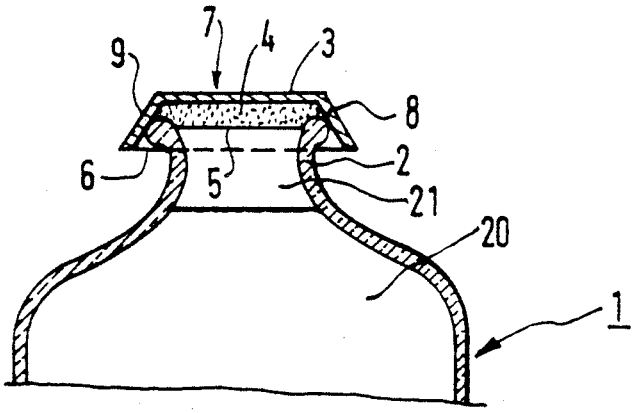
FIG. 1 is a partial cross section of a bottle with a sealing cap according to the invention.

In FIG. 1, the neck 2 of the bottle 1 bears a cap 7 to hermeticaly seal the bottle 1 containing a liquid beverage 20. The top of that beverage 20 is provided with a gaseous atmosphere 21 which is according to prior art, air or an inert gas such as nitrogen when the air has been flushed out. The complete purge of this space may be avoided, according to the invention, by providing a cap 7, the walls 8, 3, and 9 of which define an internal cavity wherein oxygen absorber means 4 are provided and separated from the atmosphere 21 by a polymer film 5 as disclosed hereabove. This film acts, as usual, as a seal between the neck 2 of the bottle 1 and the cap 7.

Figure 2:
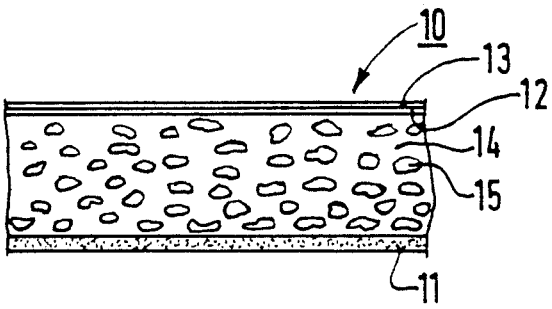
FIG. 2 is a partial enlarged cross section of a packing according to the invention adapted to be placed in a container's lid or cap.

FIG. 2 dicloses a partial enlarged cross section view of a packing adapted to be placed on the internal cavity of the cap 7 or internal face of the lid of a container. This packaging 10 has the shape of a bag having a first wall 11 and a second wall provided with an internal polymeric film 12 (porous or non porous) coated with a layer 13 of a heat sealing material such as polyvinylidene chloride (PVDC) to adhere to the internal face of the lid or cap. The bag 10 contains oxygen absorber means 14 which may be iron powder 15 or the like.

The first wall 11, which is highly permeable to gaseous oxygen (in the range of 10,000 $cc/m^2 \times bar \times hour$ or more) and to water vapor, but impermeable to liquids, is preferable, according to one of the further embodiments. According to a first embodiment, this wall 11 is made on the one hand of a micro porous layer, such as a silicon rubber layer of preferably about 0.1 to 0.5 mm thick and having a permeability of at least 10,000 $cc/m^2 \times bar \times hour$ and, on the other hand, of a macro porous layer of a rigidifying material such as a polymer film or the like having a permeability greater than that of the micro porous layer and preferably at least 10 times the permeabilty of said micro porous layer.

According to a second embodiment, the wall 11 may be a non woven fabric layer made of an hydrophobic material, such as an hydrophobic polymer (Polytetrafluoroethylene, Polyethylene terephtalate, or the like).

Figure 3:
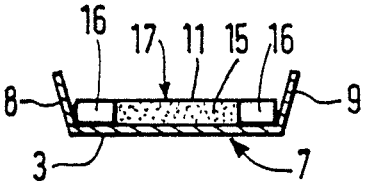
FIG. 3 is a cross section view of a sealing cap according to another embodiment of the invention.

FIG. 3 shows a preferred embodiment of a cap according to the invention wherein a sealing film 17 is provided inside the internal cavity of the cap, having an annular internal rim 16 on the sealing film 11 itself. The cavity 15 defined between the lateral walls of the rim 16 and the film 11 is filled with oxygen absorber means as disclosed hereabove. Of course, the film 11 has the oxygen and water vapour permeabilities disclosed hereinbefore, as well as water impermeability.

The various lids or caps according to the invention may be used either alone or in conjunction with an inert gas to partially purge the atmosphere above the liquid of remaining oxygen. In order to use a smaller quantity of oxygen absorber means as well as to limit the cost of the solution of that problem, but also because the aim is to avoid losing liquid during that purge step, various tests indicated that a (preferably) nitrogen purge until about 5% or less of oxygen is present above the said liquid, followed by the sealing of the bottle or container gave acceptable results in many cases. Hovewer, in some cases like beer packaging, about 2% or less of oxygen was an acceptable limit before sealing the bottle or container with the cap or lid according to the invention.

Practically, the best results are obtained when the nitrogen purge is used until about 0.5% of oxygen is present in the said atmosphere, with an immediate sealing with the cap or lid, provided with a membrane 11, 16 of polytetrafluerethylene (single layer) and iron oxide powder between said membrane and said cap.

EXAMPLE 1

A bottle filled with beer and having a gaseous headspce of 14 ml was open and purged with air until $0_2$ partial pressure of the headspace gas reached 21%.

Oxygen absorber (iron oxide) powder was placed in the cavity 15 until filled up. A protective and permeable PTFE film having a pore diameter of 1 um was glued on the face of the rim 16 which comes in touch with the bottle neck once sealed.

The headspace of the bottle was then purged with nitrogen and sealed with the cap containing the oxygen absorbant. The initial partial pressure of oxygen in the headspace of the bottle was then about 3.5%.

This oxygen partial pressure dropped to 0.5% an hour after the bottle was sealed. A further decrease of this concentration was observed after 2 hours where residual oxygen was at 0.2%.

I claim:

1. A sealing cap for liquid food or beverage containers having an enclosed gaseous atmosphere above said liquid food or beverage and adapted for reducing the amount of any gaseous oxygen present in said enclosed atmosphere, the sealing cap comprising a sealing body with an outer surface adapted to be in contact with the external atmosphere and an inner surface facing the enclosed gaseous atmosphere above said liquid food or beverage, packing means disposed within the sealing body comprising sealed bag means, said sealed bag means including a first wall having an outer surface for contact with the enclosed gaseous atmosphere and a second wall having an outer surface for contact with the inner surface of said sealing body, and absorbing means for gaseous oxygen disposed within the sealed bag means, said first wall comprising a polymeric film permeable to gaseous oxygen and to water vapor and impermeable to liquids, said film having a permeability to gaseous oxygen of at least 10,000 $cc/m^2 \times bar \times$ hour.

2. A sealing cap according to claim 1, wherein said oxygen absorber means comprises $Fe(OH)_2$.

3. A sealing cap according to claim 1, wherein said first wall comprises a microporous layer having a permeabiilty to gaseous oxygen of at least 10,000 $cc/m^2 \times bar \times hr$.

and a macroporous layer of a ridigidying material and having a permeability greater than that of the microporous layer.

4. A sealing cap according to claim 3, wherein the permeability of said macroporous layer is at least ten times the permeability of said microporous layer.

5. A sealing cap according to claim 1, wherein said first wall comprises a nonwoven fabric layer made of a hydrophobic material.

6. A sealing cap for liquid food or beverage containers having an enclosed gaseous atmosphere above said liquid food or beverage and adapted for reducing the amount of any gaseous oxygen in said enclosed atmosphere, the sealing cap comprising a sealing body with an outer surface adapted to be in contact with the external atmosphere and an inner surface facing the enclosed gaseous atmosphere above said liquid food or beverage, packing means disposed within the sealing body comprising sealed bag means, said sealed bag means including a first wall having an outer surface for contact with the enclosed gaseous atmosphere and a second surface having an outer surface in contact with the inner surface of said sealing body, and absorber means for gaseous oxygen disposed within the sealed bag means, said first wall comprising a microporous layer of polymeric film permeable to gaseous oxygen and to water vapor and impermeable to liquids, and film having a permeability to gaseous oxygen of at least 10,000 $cc/m^2 \times bar \times$ hour and a macroporous layer of a rigidifying material and having a permeability greater than that of the microporous layer.

7. A sealing cap according to claim 6, wherein the permeability of said macroporous layer is at least ten times the permeability of said microporous layer.

8. A sealing cap according to claim 6, wherein said oxygen absorber means comprises $Fe(OH)_2$.

* * * * *